US005300950A

United States Patent [19]

Lopez et al.

[11] Patent Number: 5,300,950

[45] Date of Patent: Apr. 5, 1994

[54] INTERLACED INK JET PRINTER

[75] Inventors: Juan E. Lopez, Newbury Park; Dung Do, Burbank, both of Calif.

[73] Assignee: DataProducts Corporation, Woodland Hills, Calif.

[21] Appl. No.: 876,913

[22] Filed: Apr. 30, 1992

Related U.S. Application Data

[63] Continuation of Ser. No. 611,187, Nov. 9, 1990, abandoned.

[51] Int. Cl.[5] ..... B41J 2/01; B41J 2/15

[52] U.S. Cl. ..... 346/1.1; 346/140 R

[58] Field of Search ..... 346/1.1, 140 R, 33 R; 400/126, 121

[56] References Cited

U.S. PATENT DOCUMENTS

| | | | |
|---|---|---|---|
| 4,198,642 | 4/1980 | Gamblin | 346/75 |
| 4,401,991 | 8/1983 | Martin | 346/75 |
| 4,485,386 | 11/1984 | Dagna | 346/140 X |
| 4,567,570 | 1/1986 | Peer | 365/519 X |
| 4,794,407 | 12/1988 | Vonasek | 346/139 R |
| 4,864,328 | 9/1989 | Fischbeck | 346/140 |
| 4,920,335 | 4/1990 | Katenberg | 346/1.1 |
| 4,978,971 | 12/1990 | Goetz | 346/1.1 |
| 5,070,345 | 12/1991 | Lahut | 346/1.1 |

FOREIGN PATENT DOCUMENTS 0005844 12/1979 European Pat. Off. .

*Primary Examiner*—Joseph W. Hartary

*Attorney, Agent, or Firm*—Spensley Horn Jubas & Lubitz

[57] ABSTRACT

A row-interleaved printing method for use in phase change ink jet printers which minimizes appearance abnormalities when printing solid geometric shapes; minimizes the horizontal "banding-effect" caused by cross-talk between ink jets when all jets are activated; and minimize the "seaming effect" caused by paper step mechanisms when different velocity profiles are used during printing.

9 Claims, 4 Drawing Sheets

Figure 2

STEP OF 17 PIXEL ROWS

STEP OF 15 PIXEL ROWS

STEP OF 17 PIXEL ROWS

| Pixel Row | Pass 1 → Jet j | Pass 2 ← Jet j | Pass 3 → Jet j | Pass 4 ← Jet j |
|---|---|---|---|---|
| 1 | 9 | | | |
| 2 | | 1 | | |
| 3 | 10 | | | |
| 4 | | 2 | | |
| 5 | 11 | | | |
| 6 | | 3 | | |
| 7 | 12 | | | |
| 8 | | 4 | | |
| 9 | 13 | | | |
| 10 | | 5 | | |
| 11 | 14 | | | |
| 12 | | 6 | | |
| 13 | 15 | | | |
| 14 | | 7 | | |
| 15 | 16 | | | |
| 16 | | 8** | | |
| 17 | | | 1 | |
| 18 | | 9 | | |
| 19 | | | 2 | |
| 20 | | 10 | | |
| 21 | | | 3 | |
| 22 | | 11 | | |
| 23 | | | 4 | |
| 24 | | 12 | | |
| 25 | | | 5 | |
| 26 | | 13 | | |
| 27 | | | 6 | |
| 28 | | 14 | | |
| 29 | | | 7 | |
| 30 | | 15 | | |
| 31 | | | 8 | |
| 32 | | 16 | | |
| 33 | | | 9* | |
| 34 | | | | 1 |
| 35 | | | 10 | |
| 36 | | | | 2 |
| 37 | | | 11 | |
| 38 | | | | 3 |
| 39 | | | 12 | |
| 40 | | | | 4 |
| 41 | | | 13 | |
| 42 | | | | 5 |
| 43 | | | 14 | |
| 44 | | | | 6 |
| 45 | | | 15 | |
| 46 | | | | 7 |
| 47 | | | 16 | |
| 48 | | | | 8** |
| 49 | | | | |
| 50 | | | | 9 |
| 51 | | | | |
| 52 | | | | 10 |
| 53 | | | | |
| 54 | | | | 11 |
| 55 | | | | |
| 56 | | | | 12 |
| 57 | | | | |
| 58 | | | | 13 |
| 59 | | | | |
| 60 | | | | 14 |
| 61 | | | | |
| 62 | | | | 15 |
| 63 | | | | |
| 64 | | | | 16 |

Figure 3

STEP OF 15 PIXEL ROWS

STEP OF 15 PIXEL ROWS

STEP OF 15 PIXEL ROWS

| Pixel Row | Pass 1 → Jet j | Pass 2 ← Jet j | Pass 3 → Jet j | Pass 4 ← Jet j |
|---|---|---|---|---|
| 1 | 8 | | | |
| 2 | | 1 | | |
| 3 | 9 | | | |
| 4 | | 2 | | |
| 5 | 10 | | | |
| 6 | | 3 | | |
| 7 | 11 | | | |
| 8 | | 4 | | |
| 9 | 12 | | | |
| 10 | | 5 | | |
| 11 | 13 | | | |
| 12 | | 6 | | |
| 13 | 14 | | | |
| 14 | | 7 | | |
| 15 | 15 | | | |
| 16 | | 8* | | |
| 17 | 16 | | 1 | |
| 18 | | 9 | | |
| 19 | | | 2 | |
| 20 | | 10 | | |
| 21 | | | 3 | |
| 22 | | 11 | | |
| 23 | | | 4 | |
| 24 | | 12 | | |
| 25 | | | 5 | |
| 26 | | 13 | | |
| 27 | | | 6 | |
| 28 | | 14 | | |
| 29 | | | 7 | |
| 30 | | 15 | | |
| 31 | | | 8* | |
| 32 | | 16 | | 1 |
| 33 | | | 9 | |
| 34 | | | | 2 |
| 35 | | | 10 | |
| 36 | | | | 3 |
| 37 | | | 11 | |
| 38 | | | | 4 |
| 39 | | | 12 | |
| 40 | | | | 5 |
| 41 | | | 13 | |
| 42 | | | | 6 |
| 43 | | | 14 | |
| 44 | | | | 7 |
| 45 | | | 15 | |
| 46 | | | | 8 |
| 47 | | | 16 | |
| 48 | | | | 9 |
| 49 | | | | |
| 50 | | | | 10 |
| 51 | | | | |
| 52 | | | | 11 |
| 53 | | | | |
| 54 | | | | 12 |
| 55 | | | | |
| 56 | | | | 13 |
| 57 | | | | |
| 58 | | | | 14 |
| 59 | | | | |
| 60 | | | | 15 |
| 61 | | | | |
| 62 | | | | 16 |
| 63 | | | | |
| 64 | | | | |

INTERLACED INK JET PRINTER

This is a continuation of application Ser. No. 07/611,187 filed on Nov. 9, 1990, now abandoned.

CROSS-REFERENCE TO RELATED APPLICATIONS

The present application is related to Ser. No. 07/474,556 and Ser. No. 07/474,555, now U.S. Pat. No. 5,070,345, both of which were filed on Feb. 2, 1990, both of which are entitled INTERLACED INK JET PRINTING, both of which are assigned to the same assignee as the present application, and both of which are incorporated herein by reference.

FIELD OF THE PRESENT INVENTION

The present invention is directed toward phase change ink jet printers and, more particularly, to an improved method and system for printing therewith which minimizes appearance abnormalities.

BACKGROUND OF THE PRESENT INVENTION

Both Ser. No. 07/474,556 and Ser. No. 07/474,555 disclose a row-interleaved printing method for use in phase change (also referred to as thermoplastic or hot melt) ink jet printers of the drop-on-demand (also known as impulse) and continuous types. The interleaving (also called interlacing) method disclosed in these related applications is intended to minimize appearance abnormalities when printing solid geometric shapes; minimize the horizontal "banding-effect" caused by cross-talk between ink jets when all jets are activated; and minimize the "seaming effect" caused by paper step mechanisms when different velocity profiles are used during printing. This is achieved by meeting the three following guidelines:

1) Adjacent dot rows should not be laid down in the same pass.
2) Each dot row should be sandwiched by either (a) virgin paper on both sides of the dot row, or (b) ink on both sides of the dot row. If a dot row is laid down with ink on one side and virgin paper on the other side, non-uniformity would be the result.
3) The first and the last dot row in each solid pattern are exempted from guidelines #2 and #3.

The following are the reasons behind the above guidelines:

1) Guideline #1 is to prevent adjacent dot rows to fuse together forming a band of dots per pass.
2) Guideline #2 is to maintain thermal symmetry within a solid pattern.
3) The first and the last dot row of each printed pattern is exempted from the symmetry requirement because these rows represent the transition from one color to another and therefore do not have to be uniform or symmetrical on both sides of the dot row.

SUMMARY OF THE PRESENT INVENTION

The present invention is directed to an improved process and system for printing onto a substrate for use in a phase change ink jet printer having a print head comprised of a slanted array of 2n (or 2n−1) jetting nozzles having a uniform vertical spacing V; the improved process and system including the steps of:

(1) positioning the substrate opposite the print head and then activating only nozzles n to 2n−1 during one pass of the print head; to set heated ink droplets (2) advancing the substrate a distance of about (2n−1)*(V/2) and then activating only nozzles 1 to 2n−1 during the next pass of the print head;

(3) advancing the substrate a distance of about (2n−1)*(V/2) and then activating only nozzles 1 to 2n−1 during the next pass of the print head;

(4) optionally repeating steps (2) and (3) any number of times; and (5) advancing the substrate a distance of about (2n−1)*(V/2) and then activating only nozzles 1 to n during the next pass of the print head.

BRIEF DESCRIPTION OF THE DRAWINGS

FIG. 2 is a table or chart showing what jets are activated (fired) and the pixel rows they cover in the first four passes using the print head of FIG.1 when practicing an embodiment of the present invention.

FIG. 3 is a table or chart showing what jets are activated (fired) and the pixel rows they cover in the first four passes using the print head of FIG. 1 when practicing another embodiment of the present invention.

DESCRIPTION OF THE PREFERRED EMBODIMENTS

Print Head And Printer For Use In The Preferred Embodiments

Figure 1:
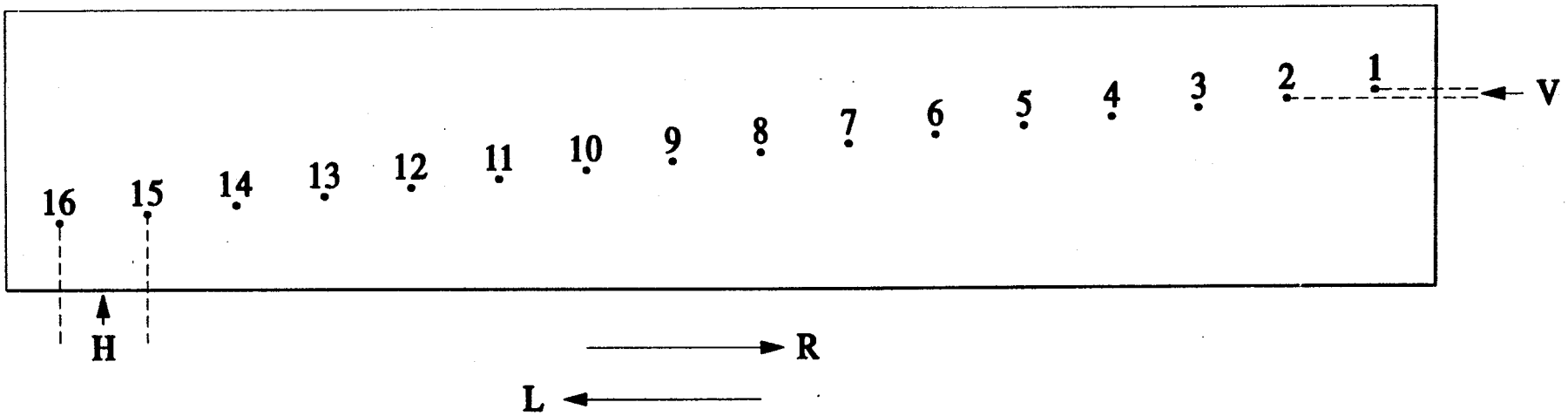
FIG. 1 is a schematic drawing of a 16-nozzle print head which may be used to practice the present invention.

The print head of FIG. 1 includes a slanted array of 16 ink jet nozzles for printing onto a substrate (e.g., paper) in which the vertical distance between pixel rows is 1/300 inches. The vertical spacing between adjacent nozzles is 2/300 inches (twice the vertical distance between adjacent pixel rows on the substrate). The horizontal distance between two adjacent nozzles is 16/300 inches.

Figure 4:
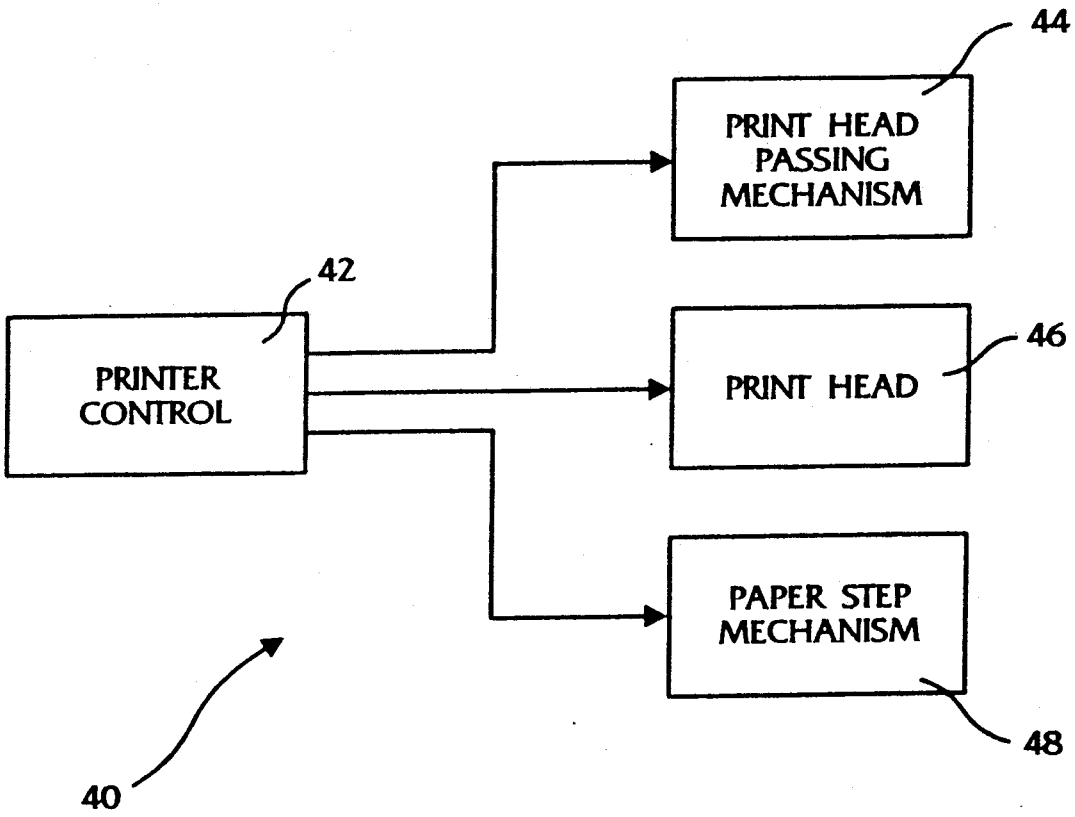
FIG. 4 is a general block diagram illustrating an apparatus for interlaced jet printing according to one embodiment of the present invention.

FIG. 4 shows the print head 46 included in an ink jet printer configuration 40. A controller 42 commands a paper step mechanism 48 to position the substrate opposite the print head 46. The controller 42 then commands a print head passing mechanism 44 to pass the print head 46 across the substrate, wherein the ink jet nozzles on the print head are activated accordingly. At the end of each pass, the paper step mechanism 48 advances the substrate and positions the substrate opposite the print head 46 in preparation for another pass as directed by the controller 42.

First Preferred Embodiment

A method in accordance with this first embodiment of the present invention is described as follows, with reference to FIG. 2 which shows the position of all the nozzles (indicated by the nozzle number) relative to the pixel rows of the paper and the nozzles fired (indicated by the nozzle number being encircled) during the first four passes of the print head and the pixel rows which each fired nozzle fills.

The substrate is initially positioned to have pixel row 1 opposite nozzle 9, the following pixel row/nozzle arrangement is achieved: 1/9, 3/10, 5/11, 7/12, 9/13, 11/14, 13/15, 15/16 for the lower 8 jets (9 to 16); the upper 8 jets (1 to 8) are above the first pixel row. In the first pass (left to right; direction R), the paper is positioned to have pixel row 1 opposite nozzle 9 as described above. During the first pass, only the lower 8 jets 9, 10, 11, 12, 13, 14, 15 and 16 are activated to cover pixel rows 1, 3, 5, 7, 9, 11, 13, 15, respectively.

The upper 8 jets (1 to 8) are NOT fired.

The paper is then stepped upward by a step of 17 pixel rows (or 17/300 inches), thereby positioning the paper to have the 2nd pixel row opposite nozzle 1 and the following pixel row/nozzle arrangement is achieved: 2/1, 4/2, 6/3, 8/4, 10/5, 12/6, 14/7 and 16/8 for the upper 8 jets (1 to 8); and 18/9, 20/10, 22/11, 24/12, 26/13, 28/14, 30/15 and 32/16 for the lower 8 jets (9 to 16). During the second pass (right to left; direction L), the top 8 jets (1 to 8) are fired to cover pixel rows 2, 4, 6, 8, 10, 12, 14 and 16, respectively. The bottom 8 jets (9 to 16) are also fired to cover pixel rows 18, 20, 22, 24, 26, 28, 30 and 34, respectively.

At the end of the second pass, the paper is advanced by a step of 15 pixel rows (or 15/300 inches), thereby positioning the paper to have the 17th pixel row opposite nozzle 1 and the following pixel row/nozzle arrangement is achieved: 17/1, 19/2, 21/3, 23/4, 25/5, 27/6, 29/7 and 31/8 for the upper 8 jets (1 to 8); and 33/9, 35/10, 37/11, 39/12, 41/13, 43/14, 45/15 and 47/16 for the lower 8 jets (9 to 16). During the third pass (left to right; direction R), the top 8 jets (1 to 8) are fired to cover pixel rows 17, 19, 21, 23, 25, 27, 29 and 31, respectively. The bottom 8 jets (9 to 16) are also fired to cover pixel rows 33, 35, 37, 39, 41, 43, 45 and 47, respectively.

At the end of the third pass, the paper is advanced by a step of 17 pixel rows (or 17/300 inches), thereby positioning the paper to have the 34th pixel row opposite nozzle 1 and the following pixel row/nozzle arrangement is achieved: 34/1, 36/2, 38/3, 40/4, 42/5, 44/6, 46/7 and 48/8 for the upper 8 jets (1 to 8). During the fourth pass (right to left; direction L), the top 8 jets (1 to 8) are fired to cover pixel rows 34, 36, 38, 40, 42, 44, 46 and 48, respectively. The bottom 8 jets (9 to 16) are NOT jetted. This completes the process for a printing a block of 48 pixel rows, namely, rows 1 to 48 (inclusive).

The actual print region on the paper can be increased to any desired dimension by simply increasing the number of passes before the last pass in which only 8 of the 16 jets are fired. It is to be noted that adjacent dot rows are never laid down in the same pass, thereby satisfying guideline #1. Further, leading (lower) jets 9 to 16 print out rows that are individually surrounded on both sides by one or more pixel rows of paper, thereby meeting guidelines #2-3. The trailing (upper) jets 1 to 8 jet ink onto unprinted (virgin) rows which are symmetrically bounded by rows of solidified ink from the previous print pass, thereby also satisfying guideline #2-3. The only exceptions are jet 9 on a left-to-right pass (e.g., pass 3), which is sandwiched between a row of solidified ink from the previous pass and a row of unprinted (virgin) paper (see "*" in FIG. 2); and jet 8 on a right-to-left pass (e.g., passes 2 and 4), which is sandwiched between a row of solidified ink from the previous pass and a row of unprinted (virgin) paper (see "**" in FIG. 2).

Second Preferred Embodiment

A method in accordance with this second embodiment of the present invention is described as follows, with reference to FIG. 3 which shows the position of all the nozzles (indicated by the nozzle number) relative to the pixel rows of the paper and the nozzles fired (indicated by the nozzle number being encircled) during the first four passes of the print head and the pixel rows which each fired nozzle fills. In this embodiment, the stepping of the substrate during each pass will be the same distance, 15/300 inches (or 15 pixel rows). This is accomplished by never firing nozzle 16.

The substrate is initially positioned to have pixel row 1 opposite nozzle 8, the following pixel row/nozzle arrangement is achieved: 1/8, 3/9, 5/10, 7/11, 9/12, 11/13, 13/14, 15/15 and 17/16 for the lower 9 jets (8 to 16); the upper 7 jets (1 to 7) are above the first pixel row. In the first pass (left to right; direction R), the paper is positioned to have pixel row 1 opposite nozzle 8 as described above. During the first pass, only jets 8, 9, 10, 11, 12, 13, 14 and 15 are activated to cover pixel rows 1, 3, 5, 7, 9, 11, 13, 15, respectively. Jets 1-7 and 16 are NOT fired.

The paper is then stepped upward by a step of 15 pixel rows (or 15/300 inches), thereby positioning the paper to have the 2nd pixel row opposite nozzle 1 and the following pixel row/nozzle arrangement is achieved: 2/1, 4/2, 6/3, 8/4, 10/5, 12/6, 14/7, 16/8, 18/9, 20/10, 22/11, 24/12, 26/13, 28/14, 30/15 and 32/16. During the second pass (right to left; direction L), the top 15 jets are fired to cover pixel rows 2, 4, 6, 8, 10, 12, 14, 16, 18, 20, 22, 24, 26, 28, 30 and 34, respectively. Jet 16 is NOT fired.

At the end of the second pass, the paper is again advanced by a step of 15 pixel rows (or 15/300 inches), thereby positioning the paper to have the 17th pixel row opposite nozzle 1 and the following pixel row/nozzle arrangement is achieved: 17/1, 19/2, 21/3, 23/4, 25/5, 27/6, 29/7, 31/8, 33/9, 35/10, 37/11, 39/12, 41/13, 43/14, 45/15 and 47/16. During the third pass (left to right; direction R), jets 1-15 are fired to cover pixel rows 17, 19, 21, 23, 25, 27, 29, 31, 33, 35, 37, 39, 41, 43, 45 and 47, respectively.

At the end of the third pass, the paper is advanced again by a step of 15 pixel rows (or 15/300 inches), thereby positioning the paper to have the 32nd pixel row opposite nozzle 1 and the following pixel row/nozzle arrangement is achieved: 32/1, 34/2, 36/3, 38/4, 40/5, 42/6, 44/7, 46/8, 48/9, 50/10, 52/11, 54/12, 56/13, 58/14, 60/15 and 62/16. During the fourth pass (right to left; direction L), only the top 8 jets (1 to 8) are fired to cover pixel rows 32, 34, 36, 38, 40, 42, 44 and 46, respectively. The bottom 8 jets (9 to 16) are NOT jetted. This completes the process for a printing a block of 46 pixel rows, namely, rows 1 to 46 (inclusive).

Again, the actual print region on the paper can be increased to any desired dimension by simply increasing the number of passes before the last pass in which only 8 of the 16 jets are fired.

As in the first embodiment, adjacent dot rows are never laid down in the same pass, thereby satisfying guideline #1. Further, only jet 8 in passes other than the first and the last (as indicated by the * in FIG. 3) prints out a row that does not meet guidelines 2-3. All other jets either print onto a row surrounded on both sides by a pixel row of virgin paper, or print onto a row surrounded on both sides by a row of solidified ink from the previous print pass. It will be recalled that jet 8 in the last pass is exempted from guideline #2 under guideline #3.

This second embodiment is ideally suited for use with a print head having only 15 jets (or any odd number of jets), since the 16th (or last) jet is never fired.

Other Embodiments

While the description above refers to particular preferred embodiments of the present invention, it will be understood that many modifications thereto may be made without departing from the spirit or intended scope of the present invention. By way of example only, the present invention would be applicable to any ink jet printer wherein the ink is heated to an elevated temperature prior to being jetted. That is, the present invention is not necessarily limited to phase change ink jet printers. Also, the present invention can be used where rather than stepping the paper, the print head is stepped or the paper and the print head are both stepped; it is relative movement that is pertinent to the present invention. Further, the present invention is not limited to a single color ink jet printer. The present invention is equally applicable to a color ink jet printer; the only difference will be that all the available colors (e.g., black, cyan, magenta and yellow) are laid down individually or in combination in pixel rows in accordance with the method of this invention. Thus, the accompanying claims are intended to cover such modifications as would fall within the true scope and spirit of the present invention. The presently disclosed embodiments are therefore to be considered in all respects as illustrative and not restrictive, the scope of the invention being dictated by the appended claims, rather than the foregoing description, and all changes which come within the meaning and range of equivalency of the claims are therefore intended to be embraced herein.

What is claimed is:

1. An improved process for printing onto a print region of a substrate for use in an ink jet printer having a print head comprised of a slanted array of 2n numbered jetting nozzles having a uniform spacing V in a first direction, n being a positive integer and the array including a first nozzle numbered 1 at a first end of the array and a last nozzle numbered 2n at a second end of the array, the nozzles being activated to jet ink droplets onto the substrate during successive passes of the print head over the substrate in a second direction, and the print region having first and second edges which are spaced apart in the first direction; the improved process comprising the steps of:

(a) positioning the substrate opposite the print head so that the nozzle numbered n or n+1 is located substantially opposite the first edge of the print region and the nozzles between n or n+1 and 2n are located opposite the print region and then activating selected ones of only nozzles n to 2n or n+1 to 2n during a first pass of the print head to jet ink droplets; and (b) moving the substrate in the first direction relative to the print head, so that the first edge moves away from the array of nozzles, in a plurality of increments having increment lengths which alternate between an increment length of about $(2n+1)\cdot(V/2)$ and an increment length of about $(2n-1)\cdot(V/2)$, and effecting a pass of the print head in the second direction while activating selected ones of nozzles 1 to 2n after each increment of movement in the first direction.

2. The process of claim 1 wherein n=8.

3. The process of claim 2 wherein V=2/300th of an inch.

4. The process of claim 3 wherein the ink is a phase change ink and the printer is a phase change ink printer.

5. In an improveed ink jet printer having a print head comprised of a slanted array of 2n numbered jetting nozzles having a uniform spacing V in a first direction, n being a positive integer and the array including a first nozzle numbered 1 at a first end of the array and a last nozzle numbered 2n at a second end of the array, the nozzles being activated to jet ink droplets onto a print region of a substrate during successive passes of the print head over the substrate in a second direction, and the print region having first and second edges which are spaced apart in the first direction; the improvement comprising:

control means for positioning the substrate opposite the print head so that the nozzle numbered n or n+1 is located substantially opposite the first edge of the print region and the nozzles between n to 2n or n+1 and 2n are located opposite the print region and then activating selected nozzles, said control means having means for:

(1) activating only selected ones of nozzles n or n+1 to 2n during a first pass of the print head to jet ink droplets; and (2) advancing the substrate in the first direction relative to the print head, so that the first edge moves away from the array of nozzles, in a plurality of increments having increment lengths which alternate between an increment length of about $(2n+1)\cdot(V/2)$ and an increment length of about $(2n-1)\cdot(V/2)$, and effecting a pass of the print head in the second direction while activating selected ones of nozzles 1 to 2n after each increment of movement in the first direction.

6. The printer of claim 5 wherein n=8.

7. The printer of claim 6 wherein V=2/300th of an inch.

8. The printer of claim 5 wherein the ink is a phase change ink and the printer is a phase change ink printer.

9. The printer of claim 8 wherein the phase change ink printer is of the impulse type.

* * * * *